US005263224A

United States Patent [19]

Lovelady

[11] Patent Number: 5,263,224

[45] Date of Patent: Nov. 23, 1993

[54] WET VACUUM ATTACHMENT FOR VACUUM CLEANERS

[76] Inventor: Gary Lovelady, 355 Meadowbrook Dr., Santa Maria, Calif. 93455

[21] Appl. No.: 766,018

[22] Filed: Sep. 26, 1991

[51] Int. Cl.[5] ..... A47L 7/00

[52] U.S. Cl. ..... 15/353; 15/322; 15/375; 15/422

[58] Field of Search ..... 15/321, 322, 353, 375, 15/422, 328

[56] References Cited

U.S. PATENT DOCUMENTS

| | | | |
|---|---|---|---|
| 1,014,027 | 1/1912 | Walter . | |
| 1,454,381 | 5/1923 | Stepp | 15/321 |
| 2,617,138 | 12/1948 | Brown, Sr. et al. | 15/321 |
| 2,635,277 | 4/1953 | Belknap | 15/322 |
| 3,267,511 | 8/1966 | Meyerhoefer | 15/353 |
| 3,616,482 | 11/1971 | Brycki | 15/321 |
| 4,041,569 | 8/1977 | Petersen | 15/353 |
| 4,055,405 | 10/1977 | Thun-Hohenstein | 55/216 |
| 4,179,769 | 12/1979 | Lundquist | 15/353 |
| 4,216,563 | 8/1980 | Cyphert | 15/321 |
| 4,226,000 | 10/1980 | Tribolet | 15/321 |
| 4,287,635 | 9/1981 | Jacobs | 15/321 |
| 4,329,756 | 5/1982 | Chicoine et al. | 15/321 |
| 4,341,540 | 7/1982 | Howerin | 15/353 X |
| 4,476,608 | 10/1984 | Rasmussen | 15/353 |
| 4,675,936 | 6/1987 | Rawlins | 15/353 |
| 4,788,738 | 12/1988 | Monson et al. | 15/320 |
| 4,798,613 | 1/1989 | Hetherington et al. | 55/52 |
| 4,841,595 | 6/1989 | Wiese | 15/352 |
| 4,847,943 | 7/1989 | Blase et al. | 15/352 |
| 4,930,178 | 6/1990 | Monson et al. | 15/320 |
| 4,934,021 | 6/1990 | Lenting | 15/353 |
| 5,105,504 | 4/1992 | Brzoska | 15/353 X |

*Primary Examiner*—Chris K. Moore

*Attorney, Agent, or Firm*—Blakely, Sokoloff, Taylor & Zafman

[57] ABSTRACT

A portable vacuum cleaner attachment, that can be attached to the end of a vacuum hose to remove and separate fluid, so that the fluid does not enter the vacuum unit. The attachment has a housing with an outlet that can be coupled to the vacuum hose, and an inlet that can engage a working surface to remove the fluid with an airstream created by the vacuum unit. Attached to the housing is a tank that stores the fluid as it is removed from the working surface. Within the tank is a first passage that provides communication between the housing inlet and the tank, and a second passage that provides communication from the tank to the housing outlet. Located in front of the first passage is a wall that deflects the fluid down into the tank, while the air flows into the second passage.

14 Claims, 2 Drawing Sheets

FIG. 3
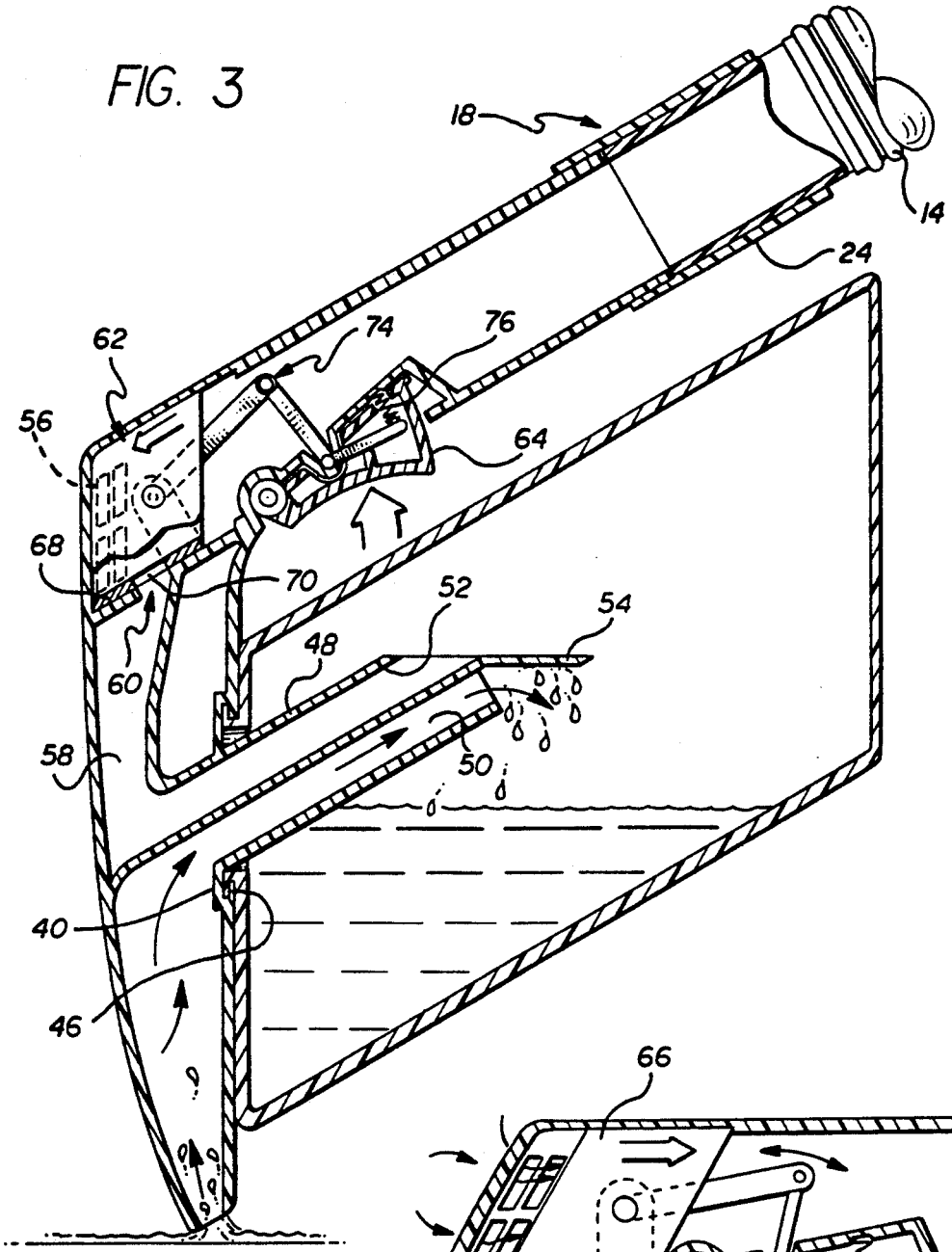
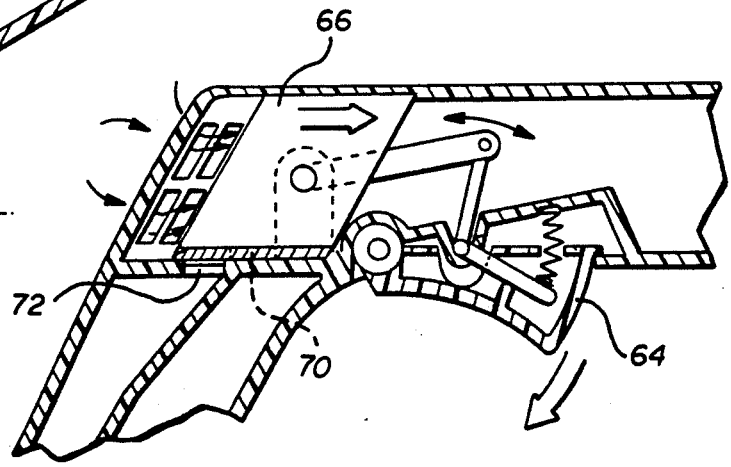
FIG. 4

WET VACUUM ATTACHMENT FOR VACUUM CLEANERS

BACKGROUND OF THE INVENTION

1. Field of the Invention

This invention relates to a vacuum cleaner attachment that can remove fluid, while preventing the fluid from being drawn into the vacuum unit.

2. Description of Related Art

Vacuum cleaners are typically used to pick up and contain foreign debris such as dust and dirt. Such devices usually do not remove fluid, because the introduction of fluid into the suction unit could cause damage to the motor and other electrical parts contained therein. Additionally, most commercially available vacuum cleaners utilize storage containers constructed from paper, which are unable to hold liquids.

U.S. Pat. No. 4,041,569 issued to Petersen, U.S. Pat. No. 4,341,540 issued to Howerin, U.S. Pat. No. 4,055,405 issued to Thun-Hohenstein, U.S. Pat. No. 3,267,511 issued to Meyerhoefer, U.S. Pat. No. 2,617,138 issued to Brown et al and U.S. Pat. No. 1,014,027 issued to Walter, all disclose a vacuum cleaner attachment that separates fluid picked up by an airstream created by the vacuum unit. Although the fluid separators of the above cited references allow the vacuum unit to remove fluid, the attachments tend to be bulky and stationary, limiting the useful range of the vacuum cleaner. Additionally, the attachments are located between the vacuum unit and the end of the hose, requiring manipulation of two separate hoses to connect and detach the separator. It would therefore be desirable to have a portable vacuum cleaner attachment, that can remove and separate fluid, and be easily detachable from the end of the vacuum hose.

SUMMARY OF THE INVENTION

The present invention is a portable vacuum cleaner attachment that can be attached to the end of a vacuum hose to remove and separate fluid, so that the fluid does not enter the vacuum unit. The attachment has a housing with an outlet that can be coupled to the vacuum hose, and an inlet that can engage a working surface to remove the fluid with an airstream created by the vacuum unit. Attached to the housing is a tank that stores the fluid as it is removed from the working surface. The tank and housing have a tongue and groove arrangement to allow the tank to be easily connected and detached from the housing. Within the tank is a first passage that provides communication between the housing inlet and the tank. Adjacent to the first passage is a second passage that provides communication between the tank and the housing outlet. Located in front of the first passage is a wall that deflects the fluid down into the tank, while the air flows around the wall and into the second passage. The wall separates the fluid that is drawn in by the airstream, such that the fluid is separated and contained by the tank.

Within the housing is a first valve that regulates the air flow through the tank. The housing also has vents between the second passage and the outlet, that can allow air to flow from the ambient to the vacuum unit. The attachment has a second valve that regulates the air flow through the vents. Connected to both valves is a trigger that can be operated by a human finger. When the trigger is depressed, the first valve is opened and the vents are closed, so that an airstream can flow from the housing inlet to the vacuum unit, wherein foreign matter and fluid can be removed. When the trigger is released, the first valve is closed and the vents are opened, such that the tank is closed off from the vacuum, while the vacuum unit can still pull air in through the vents. This allows the vacuum cleaner to remain running without having fluid or other foreign matter inadvertently drawn into the vacuum unit.

Therefore it is an object of this invention to provide a vacuum attachment that can remove and separate fluid, which is portable and can be attached to the end of a vacuum hose.

It is also an object of this invention to provide a vacuum attachment that can remove and separate fluid, which has a fluid tank that can be easily connected and detached, to allow quick disposal of the fluid in the tank.

It is also an object of this invention to provide a vacuum attachment that can remove and separate fluid, and prevent the separated fluid from being inadvertently drawn into the vacuum unit.

BRIEF DESCRIPTION OF THE DRAWINGS

The objects and advantages of the present invention will become more readily apparent to those skilled in the art after reviewing the following detailed description and accompanying drawings, wherein:

FIG. 3 is a sectional view showing valves and a trigger mechanism that is depressed so that fluid may be drawn into the attachment;

FIG. 4 is a sectional viewing showing the position of the valves when the trigger is released.

DETAILED DESCRIPTION OF THE INVENTION

Figure 1:
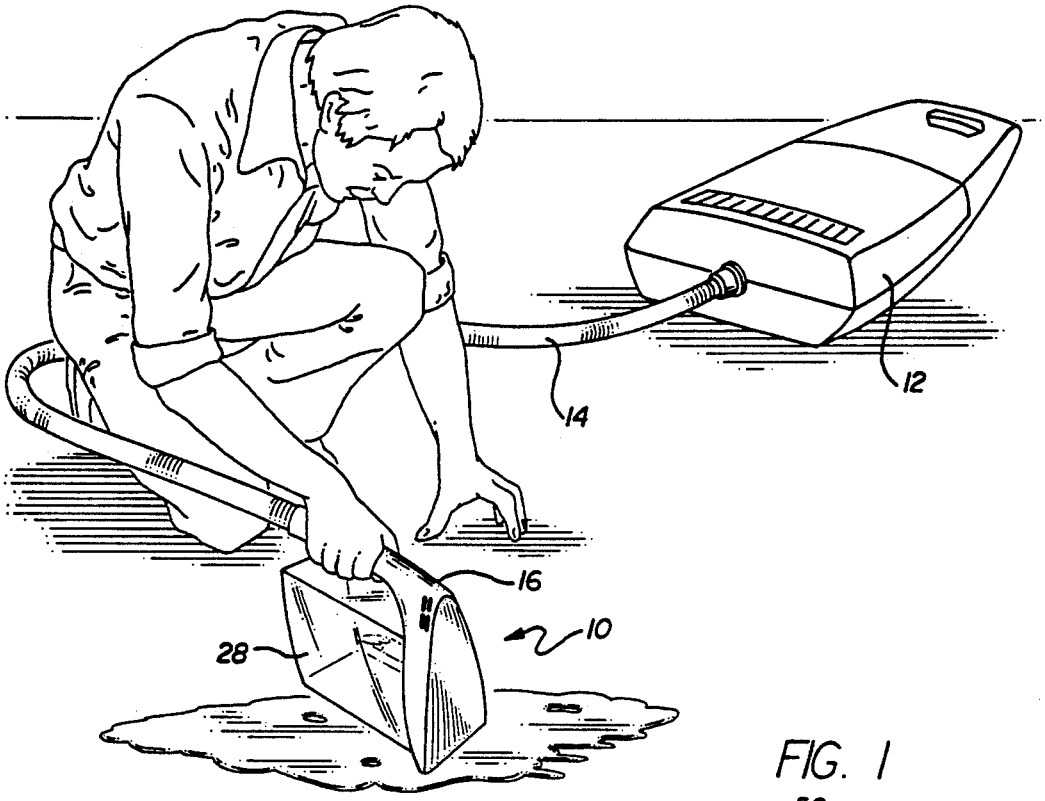
FIG. 1 is a perspective view of an attachment of the present invention connected to a vacuum hose that is coupled to a vacuum unit.
Figure 2:
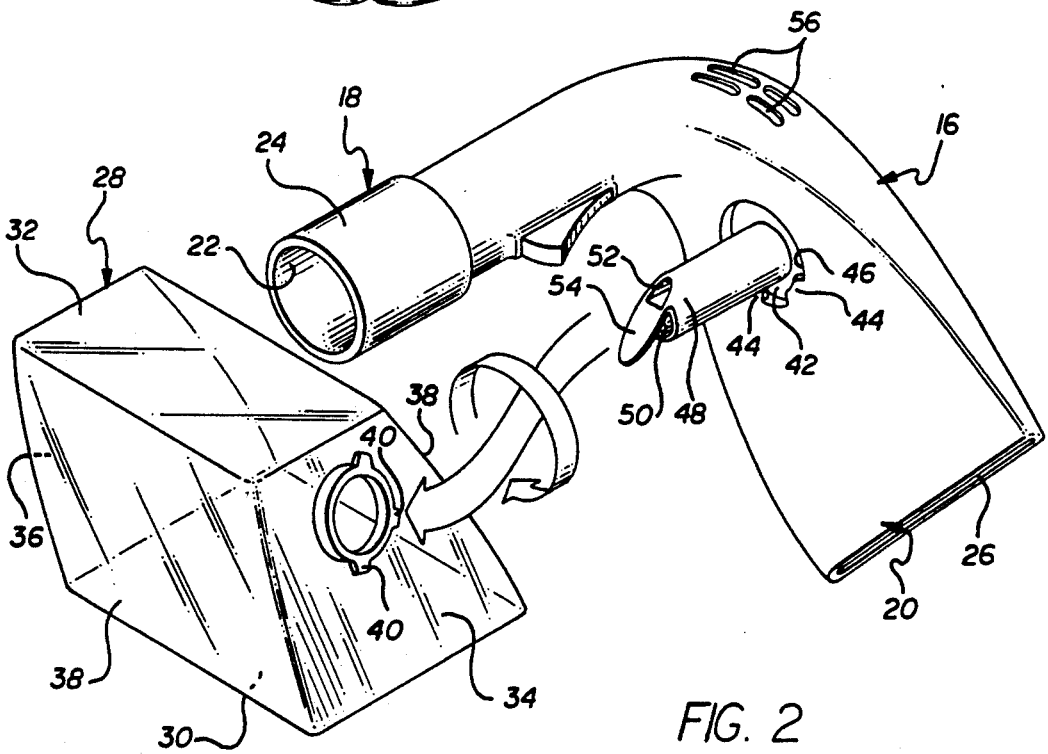
FIG. 2 is an exploded side view of a tank housing, which have a tongue and groove arrangement that allows the tank to be easily connected and detached from the housing.

Referring to the drawings more particularly by reference numbers, FIGS. 1 and 2 show an attachment 10 of the present invention that can remove liquids from a working surface. The attachment is typically used with a vacuum unit 12 and a vacuum hose 14. The vacuum unit 12 draws in air through the hose 14 to remove foreign matter, as is known in the art. The attachment 10 has a housing 16 that is typically L shaped, and has a first end 18 and a second end 20. The housing 16 is preferably constructed from plastic which is both light and durable. The first end 18 has an outlet 22 that allows air to flow from the attachment 10 to the hose 14. The first end 18 may also have an integrated collar 24, which has an internal taper that creates a stop for the hose 14. The end of the hose 14 may also have taper which can be inserted into the collar 24 until the two members fit snugly together. The second end 20 of the housing has an inlet 26 that can draw in both liquid and air.

Attached to the housing 16 is a fluid tank 28 that provides a reservoir for the fluid removed by the attachment 10. In the preferred embodiment, the tank 28 is constructed from plastic and has six walls, including a bottom wall 30, a top wall 32, a front wall 34, a back wall 36 and two side walls 38. As shown in FIG. 2, the front wall 34 of the tank 28 has a pair of tongues 40 that protrude into an annular recess 42 in the housing 16, when the front wall 34 is placed adjacent to the housing 16. The housing 16 has a pair of tabs 44 that have grooves 46 adjacent to the inner recess 42. Rotation of the tank 28 moves the tongues 40 into the grooves 46, wherein the tongues 40 and tank 28 become captured by the tabs 44 and attached to the housing 16. The fluid tank 28 can be disconnected by rotating the tank 40 in the opposite direction until the tongues 40 disengage from the tabs 44. The tongue and groove construction provides a means of easily connecting and detaching the tank 28 from the housing 16, so that the removed fluid can be easily disposed.

Within the tank 28 is a tube 48 that has a first passage and a second passage 52. The tube 48 is preferably integrally molded with the housing 16. The first passage 50 provides communication between the tank 28 and the housing inlet 26, so that air and fluid can flow from the inlet 26 into the tank 28. The second passage 52 provides communication between the tank 28 and the housing outlet 22. The passages are adjacent and preferably parallel, to reduce the overall size of the attachment 10.

The tube 48 has a wall 54 that extends in front of the first passage 50. The wall 54 changes the momentum of the fluid stream as it exists the first passage 50, so that the fluid is directed to the bottom side 30 of the tank. The vacuum pressure created by the vacuum unit 12 should be great enough to suck in fluid through the inlet 22, but low enough not to draw in fluid from the tank 28. The wall 54 provides a means to separate the fluid from the airstream, so that the removed fluid is not drawn into the vacuum unit 12.

In the preferred embodiment, the wall 54 extends in front of the first passage 50 at an oblique angle, so that the momentum of the airstream is not significantly reduced. The oblique wall 54 decreases the pressure drop through the tank 28, thereby reducing the vacuum requirement of the vacuum unit 12. The tube 48 is located an adequate distance from the bottom side 30, so that an optimum amount of fluid can be stored in the housing 24 without having fluid flowing into the second passage 52. In the the preferred embodiment, the tank 28 is shaped as a trapezoid, wherein a majority of the fluid lies near the front wall 34 and away from the passages. The trapezoid shape also allows the attachment 10 to be tipped, without fluid flowing into the second passage and the vacuum unit 12.

As shown in FIGS. 3 and 4, the housing 16 may have a plurality of vents 56 that can allow air to flow from the ambient, through the housing outlet 22 and into the vacuum unit 12. The housing 16 also has a third passage 58 that provides communication between the housing outlet 22 and the second passage 52, and between the vents 56 and the outlet 22. Within the third passage 58 is a first valve 60 and a second valve 62. The valves are connected to a trigger 64 that extends from the housing 16 and is shaped to be operated by a human finger. The second valve 62 can be a pair of walls 66 that slide within the third passage 58, to conceal and expose the vents 56. The first valve 60 may be a plate 68 that is attached to the walls 66 to move with the same. The plate 68 may have a valve hole 70 that can be aligned with an opening 72 in the third passage 58. The plate 68 and walls 66 may be pivotally attached to a linkage mechanism 74, that moves the valves when the trigger 64 is depressed and released. The linkage mechanism 74 may also have a spring 76 that biases the trigger 64 into the released position.

As shown in FIG. 3, when the trigger 64 is depressed, the first valve 60 is moved into an open position. The valve hole 70 becomes aligned with the opening 72, so that air can flow from the tank 28 to the outlet 22. At the same time, the walls 66 are moved adjacent to the vents 58 into a closed position, wherein air is prevented from flowing through the vents 58. In this state an airstream is created between the inlet 26 and the outlet 22 of the attachment. The airstream can carry fluid which is removed and contained by the tank 28.

The airstream through the attachment is discontinued when the trigger 64 is released. Once released, the spring 76 rotates the linkage mechanism 74, which moves the valves into the positions shown in FIG. 4. In the released state, the valve hole 70 and opening 72 are no longer aligned and the second valve 62 is pulled away from the vents 58, so that the vacuum unit 12 draws in air through the vents instead of the tank 28. The vents and valves allow the vacuum unit 12 to run even when the attachment 10 is not being utilized. The closing of the first valve 60 also prevents fluid or other foreign matter from inadvertently flowing into the vacuum unit 12.

While certain exemplary embodiments have been described in detail and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A portable attachment for a vacuum cleaner that has a hose and can create an airstream that removes fluid from a surface, comprising:

a housing having an inlet in communication with a first passage, and a second passage in communication with an outlet adapted to be coupled to the hose, said housing further having a vent;

a tank having an inner cavity in communication with said first and second passages;

a valve adapted to allow communication between said tank inner cavity and said housing outlet when in a first position, and allow communication between said housing outlet and said vent when in a second position;

a trigger mechanism which moves said valve between the first and second positions; and, a baffle within said tank and adjacent to said first passage.

2. The attachment as recited in claim 1, wherein said baffle is a wall extending from said housing, said wall being constructed to deflect the fluid toward a bottom side of said tank after the fluid exits said first passage.

3. The attachment as recited in claim 2, wherein said wall extends from said housing at an oblique angle.

4. The attachment as recited in claim 1, wherein said tank is shaped as a trapezoid.

5. The attachment as recited in claim 1, wherein said first and second passages are essentially parallel.

6. The attachment as recited in claim 1, further comprising attachment means for allowing said tank to be detachably connected to said housing.

7. A portable attachment for a vacuum cleaner that has a hose and can create an airstream that removes fluid from a surface, comprising:

a housing having an inlet, an outlet adapted to be coupled to the hose, said housing further having at least one vent;

a trapezoid shaped tank having a bottom side and being adapted to be attached to said housing and constructed to contain the fluid removed by the vacuum cleaner;

a first passage within said tank and spaced a predetermined distance from said bottom side of said tank, said first passage providing communication between said inlet and said tank;

a second passage that is adjacent to said first passage, said second passage providing communication between said tank and said outlet;

an oblique wall extending from said housing into said tank;

a first valve operatively connected to said housing and adapted to allow communication between said tank and said outlet when said first valve is in an open position and preventing communication between said tank and said outlet when said first valve is in a closed position;

a second valve operatively connected to said housing and adapted to allow communication between said vent and said outlet when said second valve is in an open position and preventing communication between said vent and said outlet when said second valve is in a closed position; and, a trigger operatively connected to said first and second valves, such that when said trigger is depressed said second valve is closed and said first valve is opened, and when said trigger is released said second valve is opened and said first valve is closed.

8. A portable attachment for a vacuum cleaner that can create an airstream that removes fluid from a surface, comprising:

a housing having an inlet, and an outlet adapted to be operatively connected to the vacuum cleaner, said housing further having at least one vent;

separator means attached to said housing and being in communication with said inlet and said outlet for separating the fluid from the airstream;

a valve operatively connected to said housing and adapted to allow communication between said separator means and said outlet when; and, a trigger mechanism which moves said valve between said first and second positions.

9. The attachment as recited in claim 8, wherein said separator means includes;

a tank adapted to be attached to said housing and constructed to contain the fluid removed by the vacuum cleaner;

a first passage within said tank, that provides communication between said inlet and said tank;

a second passage that is adjacent to said first passage and provides communication between said tank and said outlet; and a baffle within said tank and adjacent to said first passage such that the fluid is contained by said tank.

10. The attachment as recited in claim 9, wherein said baffle is a wall extending from said housing, said wall being constructed to deflect the fluid toward a bottom side of said tank after the fluid exits said first passage.

11. The attachment as recited in claim 10, wherein said wall extends from said housing at an oblique angle.

12. The attachment as recited in claim 11, wherein said first and second passages are essentially parallel.

13. The attachment as recited in claim 12, wherein said tank is shaped as a trapezoid.

14. The attachment as recited in claim 13, further comprising attachment means for allowing said tank to be detachably connected to said housing.

* * * * *